US005577701A

United States Patent [19]

Plzak

[11] Patent Number: 5,577,701

[45] Date of Patent: Nov. 26, 1996

[54] CHRISTMAS TREE STAND

[76] Inventor: Steve J. Plzak, 660 Williamson Rd., Bryn Mawr, Pa. 19010

[21] Appl. No.: 423,289

[22] Filed: Apr. 17, 1995

[51] Int. Cl.[6] ..... F16M 13/00

[52] U.S. Cl. ..... 248/524; 47/40.5

[58] Field of Search ..... 248/523, 524, 248/519, 230.8, 146, 156; 47/40.5

[56] References Cited

U.S. PATENT DOCUMENTS

| | | | |
|---|---|---|---|
| 2,499,753 | 3/1950 | Hubbard | 248/230.8 X |
| 2,746,700 | 4/1956 | Barbera . | |
| 3,119,585 | 1/1964 | Austenson | 248/524 X |
| 3,142,464 | 7/1964 | Zelenite . | |
| 3,779,493 | 12/1973 | Gidlof . | |
| 4,034,505 | 7/1977 | Lydall . | |
| 4,061,306 | 12/1977 | Taylor | 248/523 |
| 4,156,323 | 4/1979 | Scheffler . | |
| 4,569,151 | 2/1986 | Hoffbeck | 47/40.5 |
| 4,699,347 | 10/1987 | Kuhnley . | |
| 5,048,230 | 9/1991 | Bernardy . | |
| 5,362,024 | 11/1994 | Grinnen . | |
| 5,375,808 | 12/1994 | Roy . | |

*Primary Examiner*—Kenneth J. Dorner
*Assistant Examiner*—Jerry Redman
*Attorney, Agent, or Firm*—William H. Meise

[57] ABSTRACT

A tree stand includes a bowl 12 with a backpost 14 fastened therein. The backpost includes a set of jaws or teeth **40*u* which bear against the tree trunk. A set of upper and lower straps 60*u* and 60*l* is buckled to the backpost in a manner which allows the length to be changed. An overcenter clamp lever 64*u*, 64*l* is associated with the upper and lower straps, for tensioning the straps against the tree trunk. A set of standoffs 50 is interposed between the straps and the tree trunk at locations opposite to the jaws of the backpost. The tree stand bowl 12 has a spherical shape, which mates with a spherical bowl receptacle or base 32**, allowing the bowl to be rotated or tilted relative to the bowl receptacle, to align the tree. A set of edge fasteners clamps the edges of the bowl to the bowl receptacle at the selected position.

17 Claims, 8 Drawing Sheets

CHRISTMAS TREE STAND

FIELD OF THE INVENTION

This invention relates to stands for cut trees, such as Christmas trees.

BACKGROUND OF THE INVENTION

Cut-tree stands are widely used for supporting cut trees, especially Christmas trees. Such stands are subject to several requirements, which include the ability to hold a tree upright in a stable fashion, when the trunk of the tree may have been cut at an angle, and which may have various knots or cut branches adjacent the lower end of the trunk, which make the trunk irregular in the region in which support is required. Also, since the trunk may be curved, and the tree otherwise misshapen, it is desirable that the stand be capable of being adjusted in a manner which tilts the trunk, to allow the best appearance to be achieved. For this purpose, it is also desirable to be able to rotate the tree to put its best side toward the viewers. Further, in order to prolong the time during which the appearance of the tree is satisfactory, and to reduce the potential for fire, it is desirable that the stand hold water adjacent the cut end of the trunk of the tree. Further desiderata include the ability to collapse the stand into a small volume for storage, easy set-up, and the like.

U.S. Pat. No. 4,699,347, issued Oct. 13, 1987 in the name of Kuhnley, describes a stand including a base ring with three legs hinged thereto. The legs meet at an apex, at which a ball seat supports a ball, which can be rotated on the seat, and which may be clamped in a selected position. The ball is connected to a generally vertically disposed backplate or backpost, which is tiltable with respect to the vertical when the ball is not clamped, and which is held in position when the ball is clamped. The backpost or backplate is curved, as seen in a plane orthogonal to a vertical axis, and the concave side of the backplate is held against the tree trunk by a pair of straps without a tightening device, one near the top of the backplate, and the other near the bottom of the backplate. The straps are retained by buckles. The Kuhnley arrangement does not appear to have achieved widespread success, possibly because of the inability of the ball clamping mechanism to withstand the moments about the center of the ball which are generated by the weight of the tree. Any slippage of the ball when clamped would result in tilting of the tree, which might even overturn. Further, it appears that the backplate of Kuhnley is intended to be strapped to the tree trunk, and the straps can only be tightened, when the tree is lying on its side, and the tree is then raised to a vertical position, and the backplate is then engaged with the ball tilt arrangement. This may be expected to require substantial physical strength in the case of a large tree. Also, the Kuhnley arrangement makes no provision for watering the tree.

Another tree stand is described in U.S. Pat. No. 5,375,808, issued Dec. 24, 1994, in the name of Roy. The Roy arrangement includes three legs which support a backpost or jaw assembly. The backpost has a foot for supporting the bottom of the tree trunk, and upper and lower sets of teeth protruding radially inward, to bear against the trunk. A bar of somewhat flexible or yieldable material is hinged to the structure above the foot of the jaw. The cut end of the tree trunk is set against the foot, and a hinged bar is pressed against the tree trunk at a location above the base of the trunk, and curved about it, to press the trunk against the jaw. The bar is clamped in a position which presses the trunk firmly against the jaw. Tilt adjustment is accomplished by forcing the tree in the desired direction, which allows the trunk to pivot around the bar as a fulcrum, and allows the cut end of the tree to slip along the foot of the jaw. The Roy arrangement, while allowing the tree to be righted by simply pushing it in the desired direction, does not appear to have any way to prevent tilt from occurring inadvertently. Also, tilt can be accomplished only in planes approximately transverse to the length of the bar.

Improved cut-tree stands are desired.

SUMMARY OF THE INVENTION

A stand for a cut tree comprises an upward-facing bowl defining a bottom region about a center of the bowl. A support post, backpost or backplate is affixed to the bottom region of the bowl at a location spaced away from the center of the bowl, and projecting vertically upward from the bottom region. The backpost, in a plane orthogonal to an axis passing vertically through the center of the bowl, is generally concave as seen from the vertical axis. The backpost defines at least a lower tree-trunk engaging portion adjacent the bottom region of the bowl, and an upper tree-trunk engaging portion adjacent an upper portion of the backpost. Each of the lower and upper tree-trunk engaging portions includes a plurality of teeth, as seen in the orthogonal plane. The stand further includes a lower strap engaging the backpost, and dimensioned to extend about a tree-trunk, and to hold the tree-trunk against the teeth on the tree-facing side of the backplate. An upper strap engages the backpost at a location above the lower strap, and is likewise dimensioned to extend about the tree-trunk, and to hold the tree trunk against the teeth of the backplate. A lever including an over-center portion is affixed to the backpost and to at least one of the upper and lower straps. The lever is arranged, when operated, for tensioning at least one of the upper and lower straps, and for assuming a stable overcenter tensioned state which tends to hold the tree-trunk against the backpost. In a particular embodiment of the invention, the backpost includes a strap retaining coupler, which allows the effective length of a strap to be changed, and the upper and lower straps each have a backplate coupler at one end arranged to mate with one of the strap retaining couplers of the backplate. The strap retaining coupler of the backplate may be a simple buckle, or it may include a plurality of apertures, and the corresponding portion of the strap may be a simple hook dimensioned to mate with one of the apertures. In another embodiment, two backing support arrangements are traversed by or affixed to the straps, to bear against the tree trunk at spaced-apart locations, and to hold the straps away from the tree-trunk. The straps may pass through slots in the backing supports, so the backing supports can slide to the appropriate position before the straps are tightened. A small-tree adapter may be mated with the backplate, to present a smaller toothed circumference to a smaller tree.

According to another aspect of the invention, the bowl of the stand as so far described has a spherical outer surface, which is supported within a segment of another spherical bowl. The outer bowl segment is fixed in position, as by sitting on the floor, and the inner bowl can be rotated or tilted relative to the outer bowl, to thereby tilt or rotate the tree affixed to the backplate. A clamping arrangement clamps the upper edges of the two bowls together when the tilt is proper, to prevent further motion. The stand may be made from metal or a high-strength plastic material.

DESCRIPTION OF THE INVENTION

Figure 1:
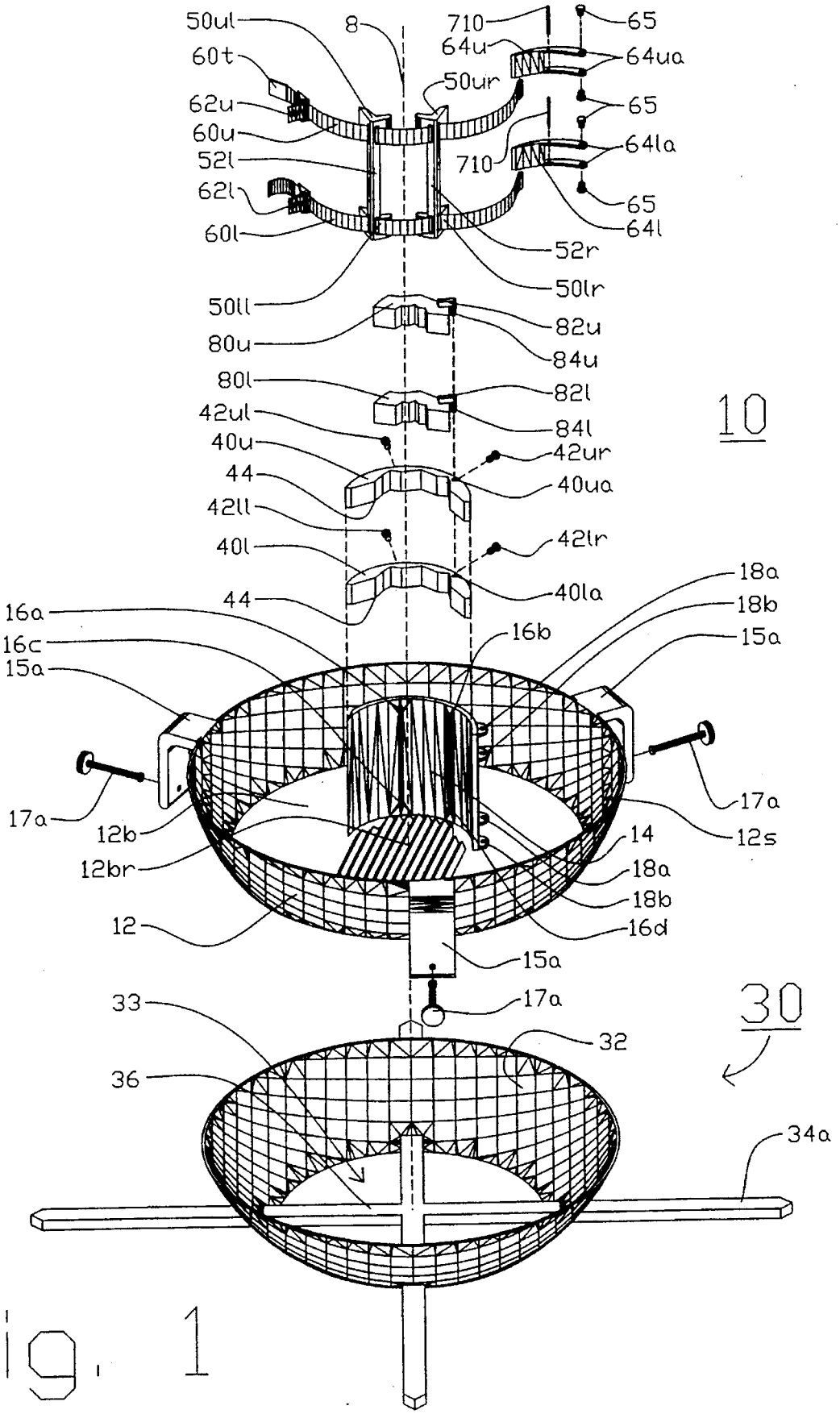
FIG. 1 is a perspective or isometric view, exploded to illustrate the relationship of the elements, of a tree stand according to the invention, including a bowl, support post, upper and lower jaw units, straps, cam buckles, over-center clamp levers, and bowl receptacle.

FIG. 1 is a simplified perspective or isometric view of a tree stand 10 according to the invention, exploded in order to illustrate the relationship of the elements. In FIG. 1, tree stand 10 includes a bowl 12 defining a bottom 12*b* and an upward-extending side 12*s* centered on an axis 8. Bottom 12*b* and side 12*s* together form a closed bowl capable of holding water. Bowl 12 has three outwardly-extending clamp lugs, one of which is designated 15*a*. A support post, backpost or backplate 14 is affixed within bowl 12. Backpost 14 is in the approximate shape of a portion of a circular cylinder, the axis of which is concentric with axis 8. Backpost 14 has a plurality of screw clearance apertures, one of which is designated 16*a*. Backpost 14 also has a plurality of outwardly-extending ears or lugs, one of which is designated 18*a*. A plurality of mutually parallel raised ridges 12*br* are defined in the bottom 12*b* of bowl 12, to engage the cut end of the tree trunk, and thereby minimize lateral displacement of the tree when mounted in the stand.

The side 12*s* of bowl 12 of FIG. 1 is in the shape of a portion of a sphere having a predetermined outer diameter. Bowl 12 fits within a bowl receptacle and support designated generally as 30. Bowl receptacle and support 30 includes a bowl receptacle 32 which is in the shape of a segment of a sphere having a diameter slightly larger than that of the bowl, to provide clearance, and to allow rotational and tilt movement of the bowl 12 within bowl receptacle and support 30. Bowl receptacle 32 has an open bottom or aperture 33, to allow spills of water to pass therethrough to the floor, where they can be readily wiped up. Bowl receptacle and support 30 also includes feet, one of which designated 34*a*, for providing a broad base for the tree stand. As illustrated in FIG. 1, bowl receptacle 32 has reinforcing members or ribs 36 extending across aperture 33. When bowl receptacle 32 receives bowl 12, the bowl may be rotated and tilted in the receptacle. When the appropriate position is found, screws 17 associated with the clamp lugs, such as screw 17*a* associated with clamp lug 15*a*, may be tightened. These screws 17 clamp the edge of the bowl receptacle between the clamp lugs and the sides 12*s* of bowl 12, to thereby prevent further movement.

Backpost or backplate 14 of FIG. 1 is the principal vertical support for the tree trunk. As mentioned above, backpost 14 is affixed within bowl 12, as by welding in the case of steel, or by forming as an integral or monolithic whole, in the case of plastic. A pair of upper and lower tooth or jaw units 40*u* and 40*l* have smooth, curved rear surfaces which mate with the curvature of the interior of backpost 14, and are affixed thereto by screws; for example, upper left screw 42*ul*, which passes through clearance aperture 16*a*, and which screws into a threaded aperture (not illustrated in FIG. 1) in the back of upper tooth unit 40*u*. A similar upper right screw 42*ur* passes through clearance hole 16*b*, and screws into the back of upper tooth unit 40*u*. Similarly, screws 42*ll* and 42*lr* extend through clearance apertures 16*c* and 16*d*, respectively, and into threaded apertures in the rear of lower tooth unit 40*l*. Instead of using screws to assemble the tooth units to the backplate, the tooth units and the backplate may be made as a unitary whole. As illustrated, the tooth or jaw units 40*l* and 40*r* have a plurality of teeth 44 on their front or tree-facing surfaces, for engaging with a tree trunk to aid in preventing unwanted movement of the tree trunk relative to backpost 14.

Figure 2:
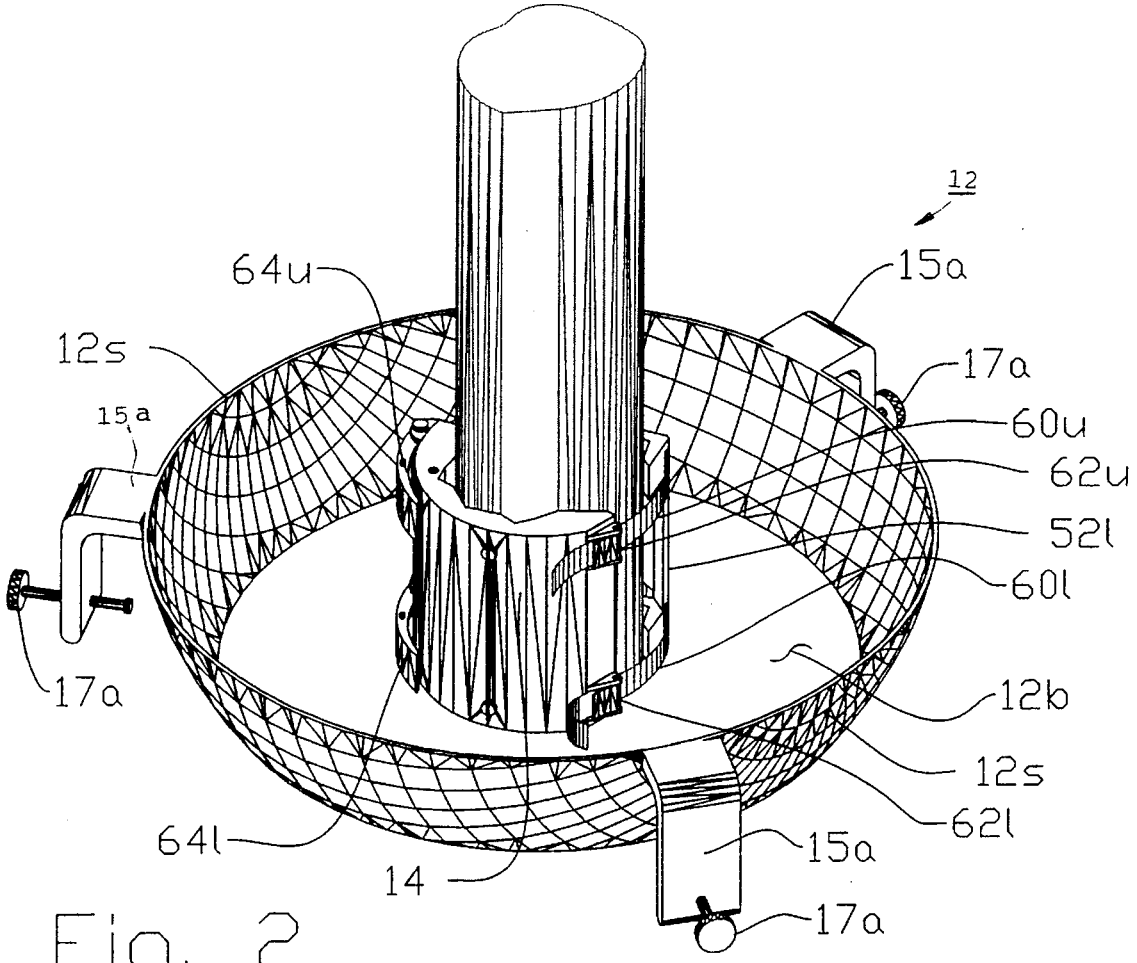
FIG. 2 is another perspective or isometric view of a bowl and support post portion of the arrangement of FIG. 1, assembled and supporting a tree.

The trunk of the tree being supported (not illustrated in FIG. 1) is clamped against the teeth 44 of the tooth units 40*u* and 40*l* by a pair of upper and lower straps 60*u* and 60*l*. The straps may be woven nylon or the like, such as are commonly used for car carrier straps or luggage straps. In FIG. 1, upper strap 60*u* has a metal tip 60*t* to prevent unravelling, and passes through a cam buckle 62*u*, which, while illustrated in conjunction with the strap in FIG. 1, is actually affixed to the left edge of backpost 14, as illustrated in FIG. 2. Cam buckle 62*u* clamps strap 60*u* in any position along its length, to thereby adjust the strap length to accommodate the particular tree trunk being clamped. Strap 60*u* extends from cam buckle 62*u*, passes through an upper left standoff 50*ul* and an upper right standoff 50*ur*, and extends to the right to an over-center upper clamping lever 64*u*. Clamping lever 64*u* includes a plurality of hinge apertures 64*ua*, which, when the lever is assembled to lugs 18*a* of backpost 14, are registered with apertures therein. Lever 64*u* is held to lugs 18*a* by screws or rivets 65 extending through the apertures 64*ua*. This arrangement allows the hinge axis of the over-center lever 64 to be outside the region through which strap 60 passes, to provide the stability of over-center operation. Lower strap 60*l* similarly includes a metal tip, passes through a cam buckle, through standoffs 50*ll* and 50*lr*, and to an over-center lever 64*l*. Left standoffs 50*ul* and 50*ll* are held in a spaced-apart relationship by a spacing member 52*l*, and right standoffs 50*ur* and 50*lr* are similarly held by a spacing member 52*r*, to form upper and lower backing support arrangements. Spacing members 52*l* and 52*r* are coupled to the upper and lower standoffs at locations on the upper and lower standoffs which are remote from those portions of the upper and lower standoffs which engage the tree trunk, so that the spacing members are spaced away from the tree trunk during use, while the upper and lower standoffs engage the tree trunk.

FIG. 1 also illustrates a pair of small-tree adapters 80*u* and 80*l*, the backs of which are formed as teeth mating with the teeth 44 of jaw units 40*l* and 40*r*, so as to fit snugly against the jaw units. Upper small-tree adapter 80*u* has a projecting tab 82*u*, which is fitted with a downward-projecting pin 84*u*. When small-tree adapter 80*u* is fitted into the teeth 44 of jaw unit 40*u*, pin 84*u* mates with an aperture 40*ua* on jaw unit 40*u*, to hold the small-tree adapter in place. Lower small-tree adapter 80*l* similarly has a projecting tab 82*l*, which is fitted with a downward-projecting pin 84*l*. When small-tree adapter 80*l* is fitted into the teeth 44 of jaw unit 40*l*, pin 84*lu* mates with an aperture 40*ul* on jaw unit 40*l*, to hold small-tree adapter 80*l* in place. Small-tree adapters 80*u* and 80*l* have jaws and teeth on the tree-trunk engaging side, which are adapter for trees with smaller-diameter trunks than the teeth and jaws of jaw units 40*u* and 40*l*.

Figure 3:
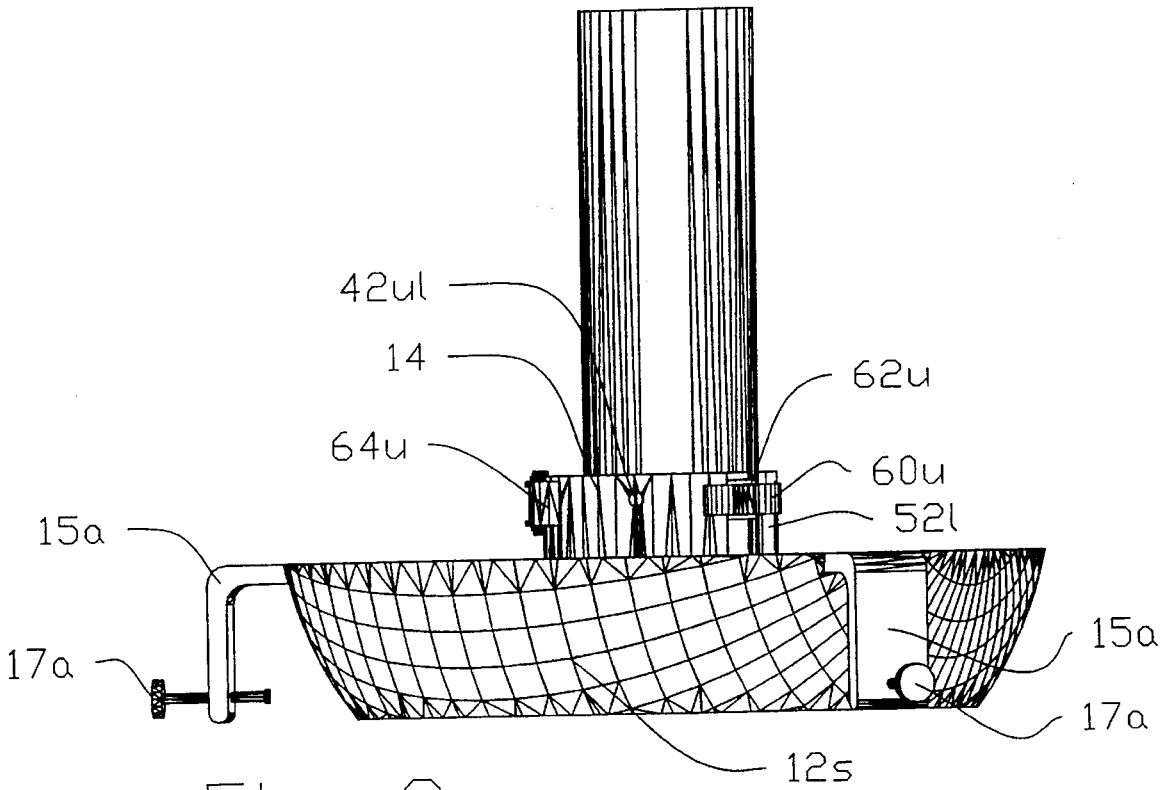
FIG. 3 is a side elevation view of the arrangement of the bowl and support post of FIG. 2.
Figure 4:
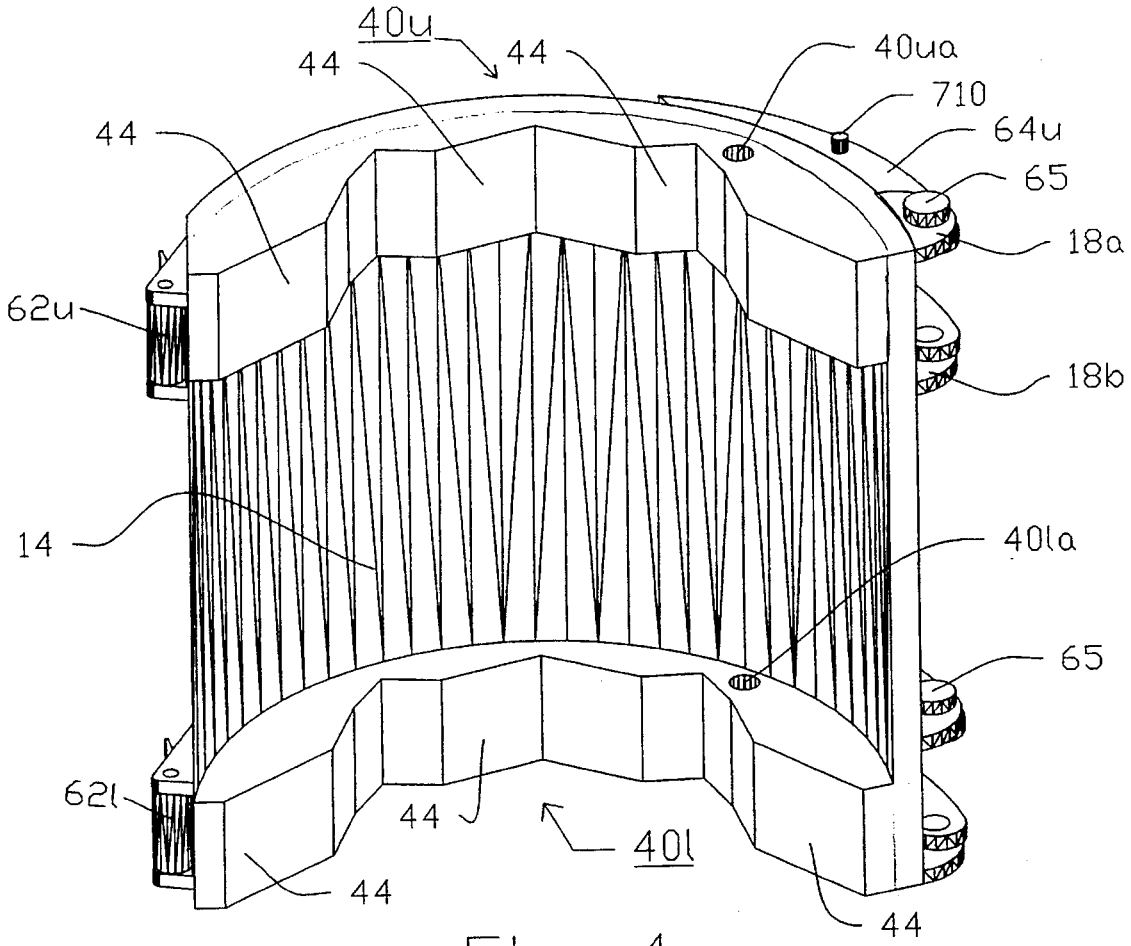
FIG. 4 is a perspective or isometric view of the tree-facing side of the tree support post of FIGS. 1 and 2.

FIG. 2 illustrates the bowl 12, backpost 14, and some other elements of the tree stand according to the invention, with a tree trunk clamped between the teeth of the backpost and the standoffs. FIG. 3 illustrates the bowl and backpost of FIG. 2, with the tree in place. FIG. 4 illustrates, in perspective or isometric view, the interior or tree-facing side of backpost 14 and jaw units 40*u* and 40*l*. The teeth 44 are arranged to engage the tree trunk at upper and lower locations.

Figure 5:
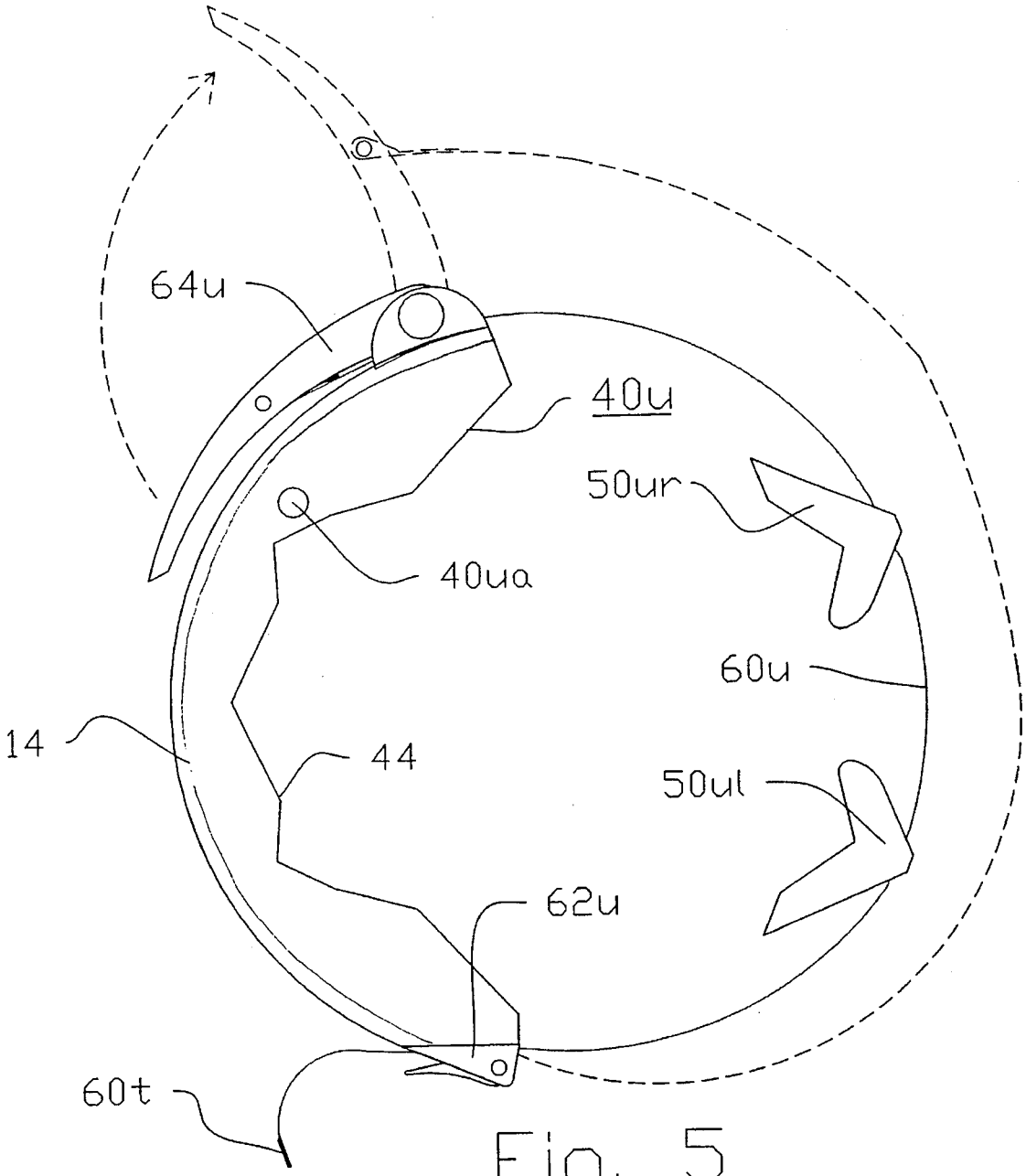
FIG. 5 is a top view of the support post and upper jaw unit of the arrangement of FIG. 1.

FIG. 5 is a simplified top view of the backpost 14, upper standoffs 50*ul* and 50*ur*, strap 60*u*, toothed jaw 40*u*, and over-center clamp lever 64*u*, to illustrate the clamping operation. The position of the strap 60*u* and lever 64*u* which is illustrated by solid lines is the clamped position. The loosened position of strap 60*u* and lever 64*u* is illustrated by phantom lines. It should be noted that the diameter of the loop, which the strap may make when lever 64*u* is in the loosened position, is determined by the amount of strap 60*u* which extends past buckle 62*u*. As also illustrated in FIG. 5, strap 60*u* passes through a slot (not separately designated in FIG. 5) in each of standoffs 50*ul* and 50*ur*, so that the standoffs are captive, but adjustable along the strap, and cannot be lost. Also, the standoffs remain in their relative positions despite loosening of the strap.

Figure 6:
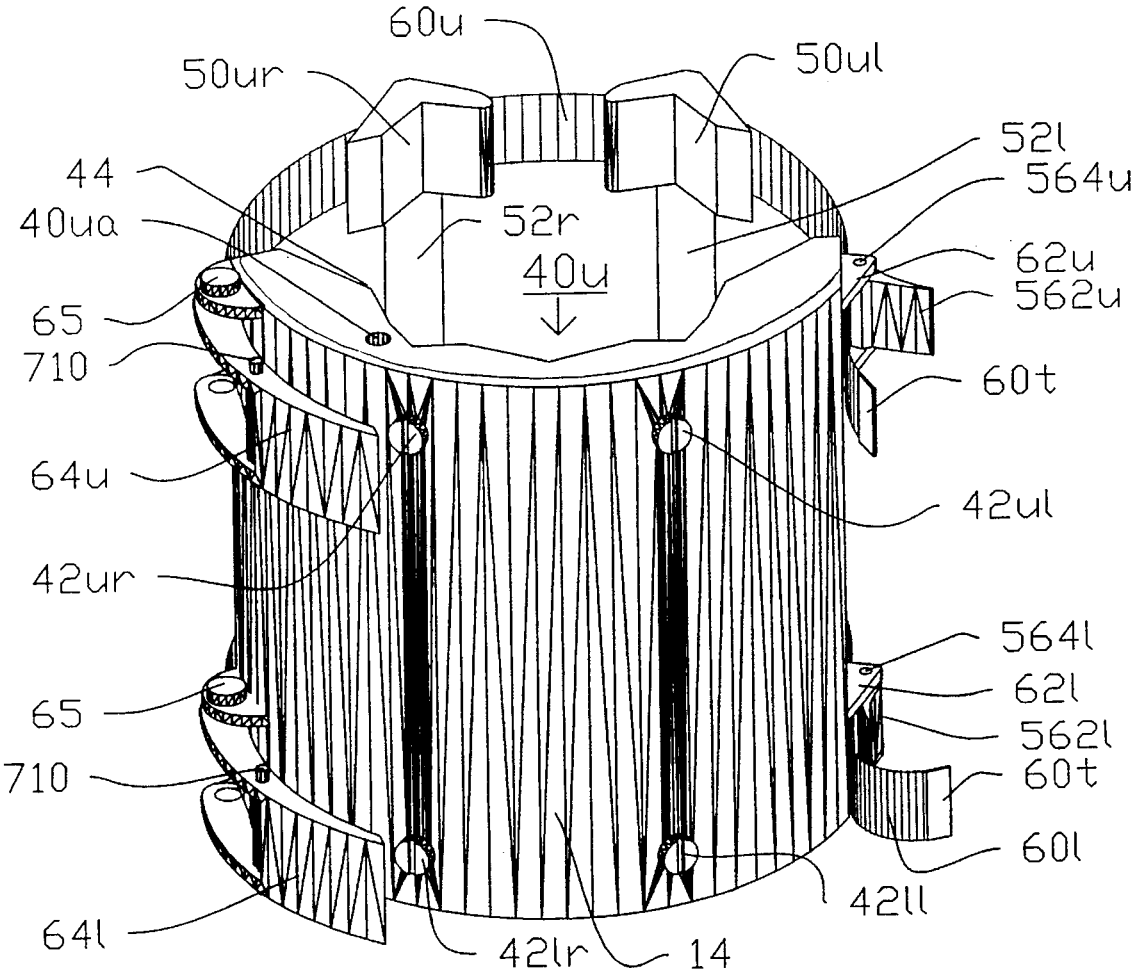
FIG. 6 is a perspective or isometric view of the rear of the support post of the arrangement of FIG. 1.

FIG. 6 is a perspective or isometric view of backpost 14, with the straps in their tensioned state, but omitting the tree trunk against which they are tensioned. In FIG. 6, the heads of screws 42*ul*, 42*ur*, 42*ll*, and 42*lr* are illustrated. As mentioned above, these screws may be used to hold the jaws 40*u* and 40*l* to backpost 14, or the screws may be dispensed with if the jaws and backpost are made as an integral or monolithic unit. Also illustrated in FIG. 6 is buckle 62*u* in its open state, with clamp lever 562*u* rotated about hinge pin 564*u* to its open position, to allow the clamping position on strap 60*u* to be adjusted. Lower buckle 62*l* has its clamp lever 562*l* rotated about hinge pin 564*l* to its closed state, in which strap 60*l* is clamped. Clamp levers 64*u* and 64*l* are illustrated in their clamped or tensioned state.

Figure 7:
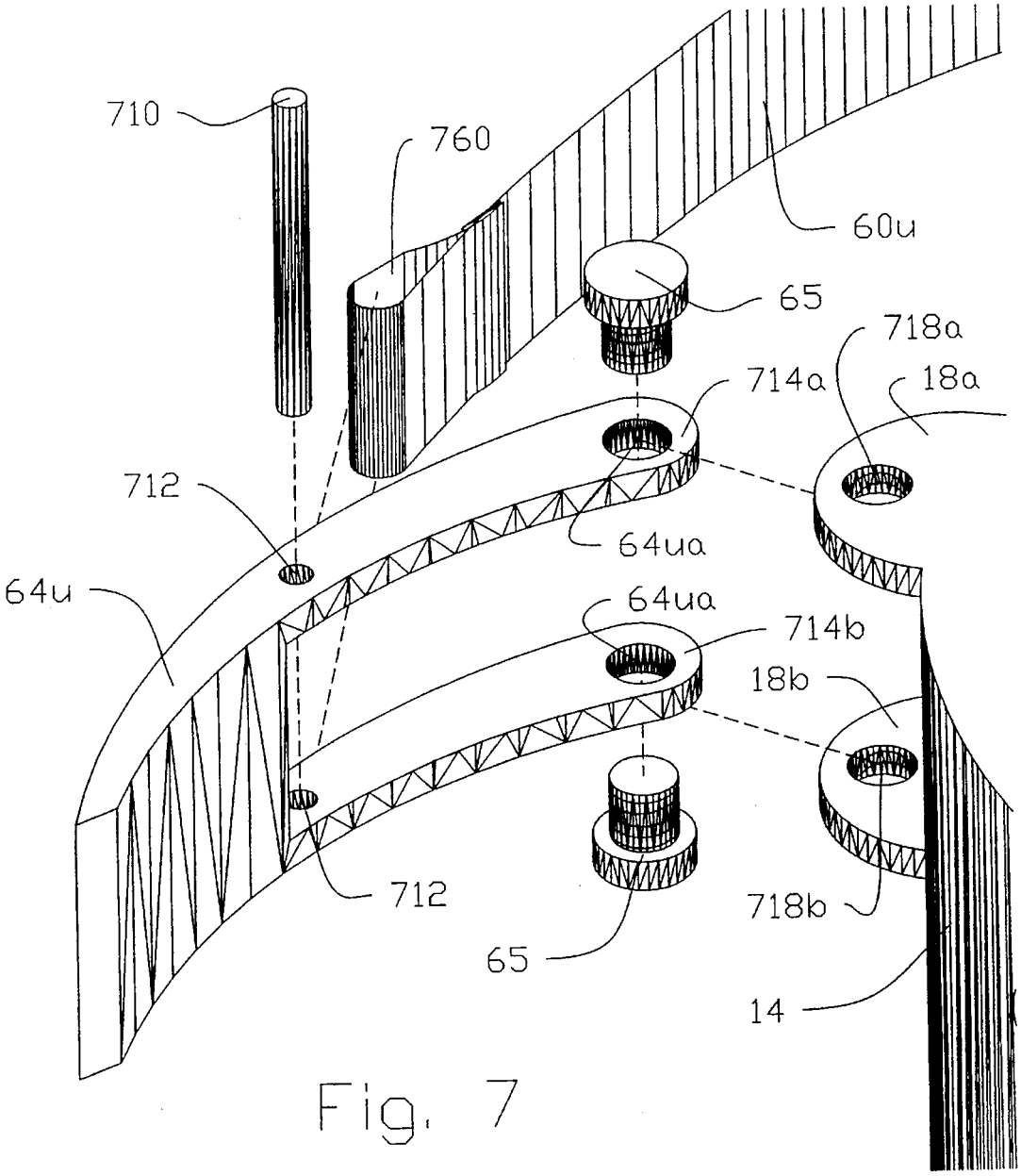
FIG. 7 is a perspective or isometric view, exploded to illustrate the various portions, of the over-center clamp lever of FIG. 1 and the associated portions of the support post.

FIG. 7 illustrates details of clamp lever 64*u*. In FIG. 7, overcenter clamp lever 64*u* includes two protruding portions 714*a* and 714*b*, each of which defines a through aperture 64*ua*, dimensioned to clear screws 65. The spacing and alignment of apertures 64*ua* are such as to match with the spacing of threaded apertures 718*a* and 718*b* in lugs 18*a* and 18*b*, respectively. Apertures 718*a* and 718*b* are threaded to match screws 65. When assembled to lugs 18*a* and 18*b*, lever 64*u* hinges about screws 65. A strap retaining pin or rivet 710 passes through apertures 712 in lever 64*u*, and through a loop 760 formed in the end of strap 60*u*. This arrangement allows the strap to pass between lugs 18*a* and 18*b*, closer to the surface of backpost 14 than the hinge axis defined by screws 65, and to terminate at pin 710, which is also near the surface of backpost 14, which is an over-center condition which maintains the tensioned position of the lever without additional locks or catches.

Figure 8:
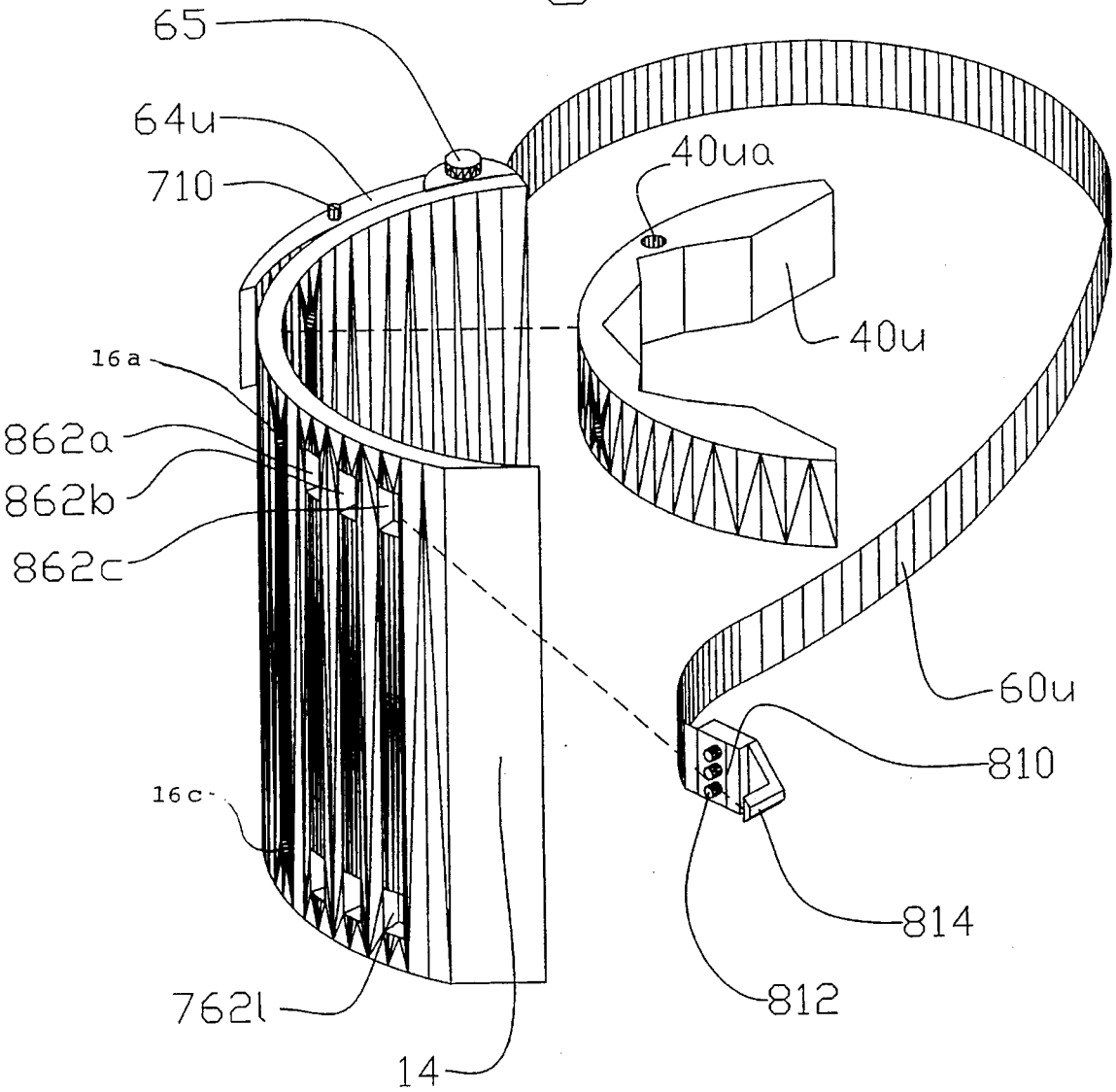
FIG. 8 is a perspective or isometric view of a portion of the rear of the support post of another embodiment of the invention, illustrating, instead of a cam buckle, a plurality of coupling apertures adapted to mate with a hook or tab on a strap.

Other embodiments of the invention will be apparent to those skilled in the art. For example, as suggested in FIG. 8, backpost 14 may, instead of buckles 62*u* and 62*l*, a series of rectangular apertures 862*a*, 862*b*, 862*c* . . . , which are dimensioned to accept a tab 814 formed at the end of a strap termination 810. An end of strap 60*u* is fastened to termination 810, as by rivets 812. The lower strap is arranged in a similar manner, with mating apertures, including aperture 762*l*, in the lower half of backpost 14. This arrangement may be cheaper than the buckles illustrated in FIGS. 1, 2, and 3, or may provide more positive retention.

What is claimed is:

1. A stand for a cut tree, comprising:

an upward-facing bowl defining a bottom region in a region about a center of said bowl;

a backpost affixed to said bottom region of said bowl at a location spaced away from said center, and projecting vertically upward from said bottom region, said backpost, in a plane orthogonal to an axis passing vertically through said center of said bowl, being generally concave as seen from said axis, said backpost defining at least a lower tree-trunk engaging portion adjacent said bottom region of said bowl, and an upper tree-trunk engaging portion adjacent an upper portion of said backpost, each of said lower and upper tree-trunk engaging portions including a plurality of teeth, as seen in said plane;

a lower strap dimensioned to extend about a tree-trunk;

an upper strap dimensioned to extend about said tree-trunk;

strap engaging means coupled to said upper and lower straps, and to said backpost, for coupling said lower strap to said backpost at a lower location near said lower tree-trunk engaging portion, and for coupling said upper strap to said backpost at an upper location above said lower location;

a lever including an over-center portion, said lever being affixed to said backpost and to at least one of said upper and lower straps, said lever being arranged, when operated, for tensioning at least one of said upper and lower straps, and for assuming a stable over-center tensioned state which tends to hold said tree-trunk against said backpost.

2. A stand according to claim 1, wherein:

said strap engaging means includes a plurality of strap retaining couplers at various positions on said backpost, selected to allow an effective length of a strap to be changed; and wherein said upper and lower straps each include a backplate coupler at one end thereof, said backpost coupler of at least one of said straps being arranged to mate with one of said strap retaining couplers, to thereby affix said one of said straps to said backpost.

3. A stand according to claim 2, wherein each of said strap retaining couplers comprises a hook recess; and said backpost coupler comprises a hook dimensioned to fit said hook recess.

4. A stand according to claim 1, wherein said strap engaging means comprises at least one cam buckle affixed to said backpost.

5. A stand according to claim 1, further comprising a plurality of spaced-apart backing support means, each of said backing support means being supported by said upper and lower straps, and extending toward said backpost from said strap, for bearing against said tree-trunk when said upper and lower straps are tensioned, and for holding said upper and lower straps away from said tree trunk.

6. A stand according to claim 5, wherein each of said backing support means comprises:

an upper standoff and a lower standoff adapted for engaging said tree-trunk; and a spacing member coupled to said upper and lower standoffs, for holding said upper and lower standoffs in a vertically spaced-apart relationship.

7. A stand according to claim 6, wherein said spacing member is coupled to said upper and lower standoffs at locations on said upper and lower standoffs which are remote from those portions of said upper and lower standoffs which engage said tree trunk.

8. A stand according to claim 1, further comprising:

adapter coupling means coupled to said backpost;

small-tree adapter means coupled to said adapter coupling means, said small-tree adapter means being shaped to mate with said lower tree-trunk engaging portion and said upper tree-trunk engaging portion of said backpost, said small-tree adapter means, in a plane orthogonal to an axis passing vertically through said center of said bowl, being generally concave as seen from said axis, said small-tree adapter means defining at least a lower tree-trunk engaging portion adjacent said bottom region of said bowl, and an upper tree-trunk engaging portion adjacent an upper portion of said backpost, each of said lower and upper tree-trunk engaging portions of said small-tree adapter including a plurality of teeth, as seen in said plane.

9. A stand according to claim 8, wherein said adapter coupling means includes an aperture in an upper portion of said backpost, and wherein said small-tree adapter includes engaging means dimensioned to engage said aperture.

10. A stand according to claim 1, wherein said bowl has the shape of a portion of a sphere of a particular diameter; and further comprising a second bowl, also in the form of a sphere, having an interior diameter slightly larger than said particular diameter, said second bowl surrounding said upward-facing bowl for support thereof; and clamping means coupled to said upward-facing and second bowls, for clamping said upward-facing and second bowls together at various relative rotational positions of said bowls.

11. A stand for a cut tree, comprising:

an upward-facing bowl defining a bottom region in a region about a center of said bowl;

a backpost affixed to said bottom region of said bowl at a location spaced away from said center, and projecting vertically upward from said bottom region, said backpost, in a plane orthogonal to an axis passing vertically through said center of said bowl, being generally concave as seen from said axis, said backpost defining at least a lower tree-trunk engaging portion adjacent said bottom region of said bowl, and an upper tree-trunk engaging portion adjacent an upper portion of said backpost, each of said lower and upper tree-trunk engaging portions including a plurality of teeth, as seen in said plane;

a lower strap dimensioned to extend about a tree-trunk;

an upper strap dimensioned to extend about said tree-trunk;

strap engaging cam buckle means coupled to said upper and lower straps, and to said backpost, for coupling said lower strap to said backpost at a lower location near said lower tree-trunk engaging portion, and for coupling said upper strap to said backpost at an upper location above said lower location;

a lever including an over-center portion, said lever being affixed to said backpost and to at least one of said upper and lower straps, said lever being arranged, when operated, for tensioning at least one of said upper and lower straps, and for assuming a stable over-center tensioned state which tends to hold said tree-trunk against said backpost;

a plurality of spaced-apart backing support means, each of said backing support means being supported by said upper and lower straps, each including portions extending toward said backpost from said strap, for bearing against said tree-trunk when said upper and lower straps are tensioned, and for holding said upper and lower straps away from said tree trunk.

12. A stand according to claim 11, wherein each of said backing support means comprises:

an upper standoff and a lower standoff adapted for engaging said tree-trunk; and a spacing member coupled to said upper and lower standoffs, for holding said upper and lower standoffs in a vertically spaced-apart relationship.

13. A stand according to claim 12, wherein said spacing member is coupled to said upper and lower standoffs at locations on said upper and lower standoffs which are remote from those portions of said upper and lower standoffs which engage said tree trunk.

14. A stand according to claim 11, further comprising:

adapter coupling means coupled to said backpost;

small-tree adapter means coupled to said adapter coupling means, said small-tree adapter means being shaped to mate with said lower tree-trunk engaging portion and said upper tree-trunk engaging portion of said backpost, said small-tree adapter means, in a plane orthogonal to an axis passing vertically through said center of said bowl, being generally concave as seen from said axis, said small-tree adapter means defining at least a lower tree-trunk engaging portion adjacent said bottom region of said bowl, and an upper tree-trunk engaging portion adjacent an upper portion of said backpost, each of said lower and upper tree-trunk engaging portions of said small-tree adapter including a plurality of teeth, as seen in said plane.

15. A stand according to claim 14, wherein said adapter coupling means includes an aperture in an upper portion of said backpost, and wherein said small-tree adapter includes engaging means dimensioned to engage said aperture.

16. A stand according to claim 11, wherein said bowl has the shape of a portion of a sphere of a particular diameter; and further comprising a second bowl, also in the form of a sphere, having an interior diameter slightly larger than said particular diameter, said second bowl surrounding said upward-facing bowl for support thereof; and clamping means coupled to said upward-facing and second bowls, for clamping said upward-facing and second bowls together at various relative rotational positions of said bowls.

17. A stand for a cut tree, comprising:

an upward-facing bowl defining a bottom region in a region about a center of said bowl;

a backpost affixed to said bottom region of said bowl at a location spaced away from said center, and projecting vertically upward from said bottom region, said backpost, in a plane orthogonal to an axis passing vertically through said center of said bowl, being generally concave as seen from said axis, said backpost defining at least a lower tree-trunk engaging portion adjacent said bottom region of said bowl, and an upper tree-trunk engaging portion adjacent an upper portion of said backpost, each of said lower and upper tree-trunk engaging portions including a plurality of teeth, as seen in said plane;

a lower strap dimensioned to extend about a tree-trunk;

an upper strap dimensioned to extend about said tree-trunk;

strap engaging cam buckle means coupled to said upper and lower straps, and to said backpost, for coupling said lower strap to said backpost at a lower location near said lower tree-trunk engaging portion, and for coupling said upper strap to said backpost at an upper location above said lower location;

a lever including an over-center portion, said lever being affixed to said backpost and to at least one of said upper and lower straps, said lever being arranged, when operated, for tensioning at least one of said upper and lower straps, and for assuming a stable over-center tensioned state which tends to hold said tree-trunk against said backpost;

a plurality of spaced-apart backing support means, each of said backing support means being supported by said upper and lower straps, each including portions extending toward said backpost from said strap, for bearing against said tree-trunk when said upper and lower straps are tensioned, and for holding said upper and lower straps away from said tree trunk;

a second bowl, also in the form of a sphere, having an interior diameter slightly larger than said particular diameter, said second bowl surrounding said upward-facing bowl for support thereof; and clamping means coupled to said upward-facing and second bowls, for clamping said upward-facing and second bowls together at various relative rotational positions of said bowls.

* * * * *